US007004350B2

(12) United States Patent
Oroumieh

(10) Patent No.: US 7,004,350 B2
(45) Date of Patent: Feb. 28, 2006

(54) DISPENSER FOR TOOTHPICKS AND TABLETS

(76) Inventor: Robert Oroumieh, 20723 Northampton, Diamond Bar, CA (US) 91789

( * ) Notice: Subject to any disclaimer, the term of this patent is extended or adjusted under 35 U.S.C. 154(b) by 165 days.

(21) Appl. No.: 10/801,194

(22) Filed: Mar. 15, 2004

(65) Prior Publication Data

US 2004/0182877 A1 Sep. 23, 2004

Related U.S. Application Data

(60) Provisional application No. 60/455,704, filed on Mar. 17, 2003.

(51) Int. Cl.
*B65H 3/62* (2006.01)

(52) U.S. Cl. ..... 221/123; 221/204; 221/288

(58) Field of Classification Search ..... 221/123, 221/124, 156, 307, 202, 252, 280, 267, 260, 221/311, 92; 206/540, 535, 528, 538
See application file for complete search history.

(56) References Cited

U.S. PATENT DOCUMENTS

| | | | | |
|---|---|---|---|---|
| 2,958,438 | A * | 11/1960 | Severson | 220/525 |
| 5,482,157 | A * | 1/1996 | Kim | 206/92 |
| 5,947,294 | A * | 9/1999 | Omata et al. | 206/534.1 |
| 2005/0155873 | A1 * | 7/2005 | Cohen | 206/37 |

* cited by examiner

*Primary Examiner*—Gene O. Crawford
*Assistant Examiner*—Timothy Waggoner
(74) *Attorney, Agent, or Firm*—Boniard I. Brown

(57) ABSTRACT

A toothpick and tablet dispenser has two housing halves force-fitted together and guide walls in at least one of the halves to guide toothpicks and tablets to different outlets to dispense a single toothpick or tablet at a time. A gate at each outlet provides manual access to the outlets and insure sanitary interior conditions.

15 Claims, 2 Drawing Sheets

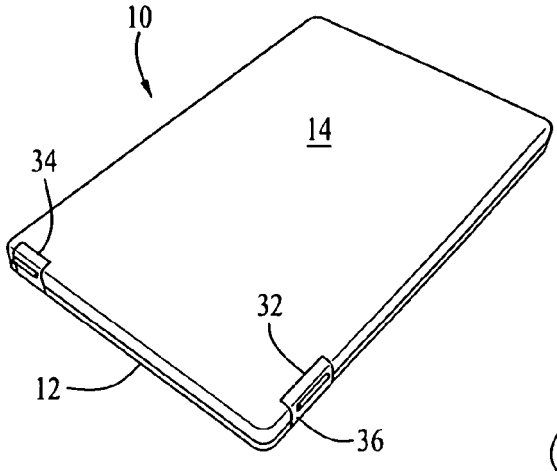
FIG. 1
FIG. 2
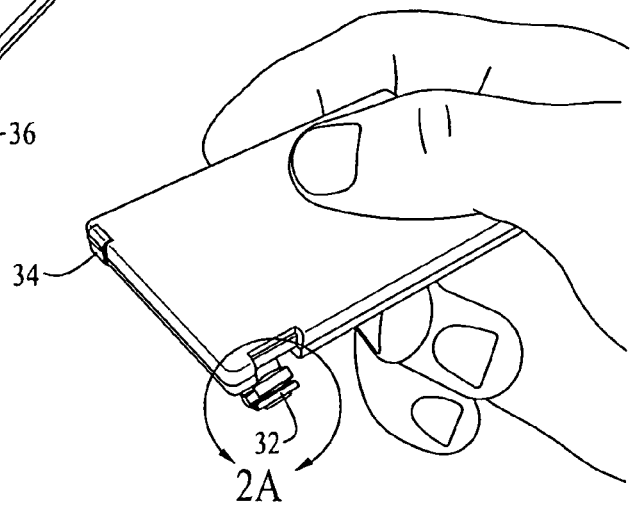
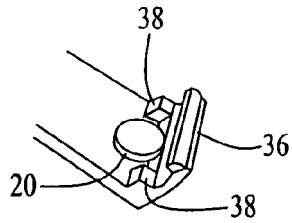
FIG. 2A
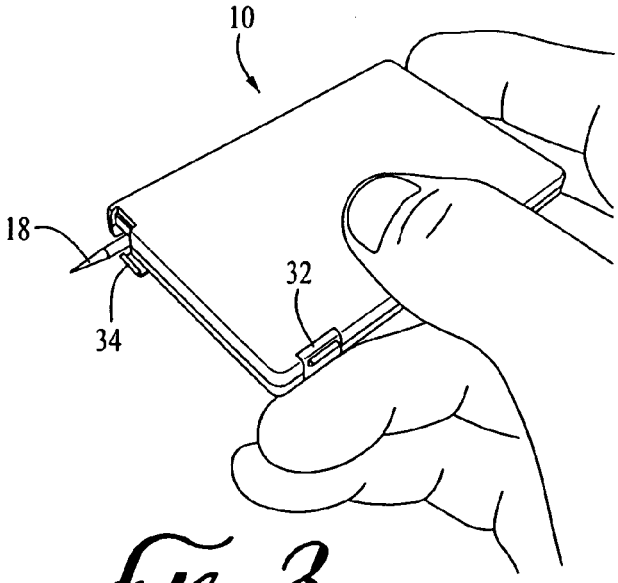
FIG. 3

DISPENSER FOR TOOTHPICKS AND TABLETS

RELATED APPLICATIONS

Reference is made to my Provisional Application No. 60/455,704, filed Mar. 17, 2003, entitled "Mint and Toothpick Dispenser".

BACKGROUND AND SUMMARY OF THE INVENTION

The prior art provides various types of toothpick dispensers and tablet dispensers having various features. None discloses or suggests applicant's claimed combinations.

The dispenser of the invention is typically rectilinear with short side walls to space two housing halves apart to define interior space.

Defined in the interior of one half of the dispenser are guide walls to guide toothpicks and tablets, the tablets typically being a mint, to respective outlets for use, and to dispense a tablet or toothpick singly, one at a time.

Objects of the invention include the provision of a sanitary, enclosed device which need not be touched by a user until the time of use, toothpicks and tablets being maintained in sanitary condition.

The dispenser is simplified, easy to utilize, durable in use and in transport, as in a pocket or purse.

BRIEF DESCRIPTION OF THE DRAWINGS

FIG. 1 is a perspective view of a preferred embodiment of the present invention;

FIG. 2 is a perspective view of the embodiment of FIG. 1, held in the hand of a user with a gate member open when dispensing a tablet;

FIG. 2A is an enlarged perspective view of a gate portion of the dispenser of FIG. 2 showing retention features for a tablet;

FIG. 3 is a perspective view of the dispenser of FIG. 1 in the hand of a user with a toothpick being dispensed.

DESCRIPTION OF PREFERRED EMBODIMENTS

Figure 4:
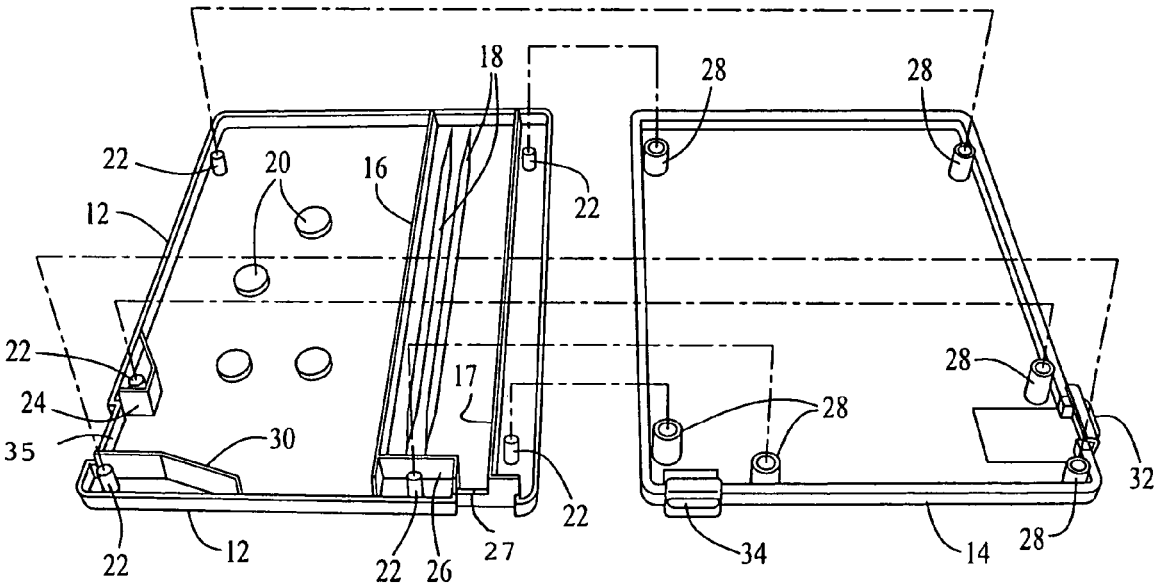
FIG. 4 is a perspective view showing two housing members of the embodiment of the dispenser of the invention showing details of internal features which provide the results and advantages according to the invention.

Referring to the drawings, a preferred embodiment 10 is shown as comprising two housing halves 12, 14 which are generally planar and which are adapted to be forced together to provide a closed dispenser, as shown in FIG. 1.

A separation wall 16 extends longitudinally and is spaced from another edge of the lower housing member 12 (FIG. 4) to provide a defined housing or space for toothpicks 18, and to separate the toothpicks from a space which accommodates a plurality of tablets or pills, typically mints, 20.

The two halves or housing members are adapted to be snapped together to provide a closed housing for tablets and toothpicks. The dispenser may typically be 3" long and 2" wide, with an overall thickness of ¼", typically.

A plurality of male posts 22 extend from the lower housing member 12, and, as shown, four of the posts are disposed near corners of the member and two are disposed at guide walls 24, 26, as shown. Mating female sockets 28 are adapted to receive the male posts in force-fitting relation to attach the lower and upper housing members together. The housing halves are manually separable by applying appropriate separation force.

Guide walls 24 and 30 serve to guide tablets or mints 20 toward outlet 35. The contours of these guide walls insure that only a single tablet will exit at one time. Guide walls 26 and 17 retain toothpicks 18 longitudinally and are configurated to insure that only a single toothpick 18 will exit the outlet opening 27 at one time. The longitudinal wall 17 and guide wall 26 define the outlet opening 27, as shown.

A dispensing gate 32 for tablets, mints or the like extends from the lower housing member 12 and is typically formed therewith. This dispensing gate is opened by the user's fingers to its position shown in FIG. 2. A retaining ridge 36 at its outer portion and retention blocks 38 at either side retain a tablet or mint 20 against falling from the gate. The tablet or mint 20 can then be removed and the gate closed, the gate being adapted to engage the upper housing member 14 in a snap fit.

A dispensing gate 34 for toothpicks is manually snapped open and is disposed on the upper housing member 14. It is manually snapped open to enable the exit of a toothpick 18 which is guided by the guide wall 26 to insure that only a single toothpick will exit at a time, as shown in FIG. 3. After the exit of a toothpick, the dispensing gate 34 is snapped shut, engaging the lower surface of lower housing member 12 in a snap fit.

The invention claimed is:

1. A dispenser for toothpicks and tablets, comprising:

first and second housing members attached together to define a dispenser housing, means to releasably attach the housing members together, respective outlet openings for toothpicks and tablets in at least one of the housing members, separation wall means in a first one of the housing members and spaced from an edge thereof to define a toothpicks retaining chamber, a plurality of first guide wall means disposed on at least one of the housing members and having portions parallel to and perpendicular to an outlet to guide a single toothpick to said outlet, and second guide wall means on one of said housing members and defining a portion of the outlet for tablets and configurated to guide a single tablet to the outlet opening.

2. A dispenser according to claim 1 wherein said separation wall means is adapted to maintain toothpicks oriented to facilitate their passing to the outlet.

3. A dispenser according to claim 1 wherein a plurality of posts are disposed near corners of one of said housing members to engage in socket members on the other housing member in a force-fit relationship to retain the housing members together.

4. A dispenser according to claim 1 wherein the second guide wall means has portions respectively parallel to and perpendicular to an edge of a housing member to retain tablets and guide a single tablet to said outlet.

5. A dispenser according to claim 1 and further comprising a gate adjacent each respective outlet and manually operable for dispensing a single toothpick via said outlet for toothpicks.

6. A dispenser for toothpicks and tablets, comprising:

first and second housing members attached together to define a dispenser housing, respective outlets for toothpicks and tablets in at least one of the housing members, separation wall means in a first one of the housing members and spaced from an edge thereof to define a toothpicks retaining chamber, first guide wall means having respective portions parallel to and perpendicular to a toothpick outlet wall and to guide a single toothpick to said outlet opening, second guide wall means adapted and positioned to align a toothpick with the toothpick outlet to eject a single toothpick at a time, and third guide wall means on one of said housing members and defining a portion of said outlet for tablets and configurated to guide a single tablet to the outlet opening.

7. A dispenser according to claim 6 wherein a plurality of posts are disposed near corners of one of said housing members to engage in socket members on the other housing member in a force-fit relationship to retain the housing members together.

8. A dispenser according to claim 6 wherein the second guide wall means has portions respectively parallel to and perpendicular to an edge of a housing member to retain toothpicks and guide a single toothpick to said outlet.

9. A combination according to claim 6 and further comprising a gate adjacent each of said outlets and manually openable to enable the dispensing of a single item therethrough, and being manually closable by engaging a housing member.

10. A dispenser according to claim 6, wberein said third guide wall means defines a portion of an outlet.

11. A dispenser for toothpicks and tablets, comprising:

first and second housing members define a dispenser housing, respective outlets for toothpicks and tablets in at least one of the housing members, separation wall means in a first one of the housing members and spaced from an edge thereof to define a toothpicks retaining chamber, first guide wall means having respective portions parallel to and perpendicular to an outlet opening wall and defining a toothpick compartment to guide a single toothpick to said outlet opening, second guide wall means on one of said housing members defining a portion of said outlet opening for tablets and configurated to guide a single tablet to the outlet opening, means to releasably attach the housing members together, and a gate on at least one of the housing members adjacent one of said respective outlets and manually operable to enable an item to pass through the outlet, said gate having a portion engagable with one of said housing members in a force-fit to secure the gate over said outlet.

12. A dispenser according to claim 11 wherein a plurality of posts are disposed near corners of one of said housing members to engage in socket members on the other housing member in a force-fit relationship to retain the housing members together.

13. A dispenser according to claim 11 wherein the second guide wall means has portions respectively parallel to and perpendicular to an edge of a housing member to retain tablets and guide a single tablet to said outlet.

14. A combination according to claim 11 and further comprising a gate adjacent each of said outlets and manually openable to enable the dispensing of a single item therethrough, and being manually closable by engaging a housing member.

15. A dispenser according to claim 11 wherein separate gates are provided, one for toothpicks and the other for tablets.

* * * * *